US009518386B2

(12) United States Patent
Ehsasi

(10) Patent No.: US 9,518,386 B2
(45) Date of Patent: Dec. 13, 2016

(54) METALLIC FRAME STRUCTURE, ASSEMBLY KIT FOR MOBILE HOUSING, MOBILE HOUSING AND HOLLOW PROFILE

(71) Applicant: Innovac Gesellschaft Fuer Vakuumphysik mbH, Berlin (DE)

(72) Inventor: Mohammad Ehsasi, Berlin (DE)

(73) Assignee: INNOVAC GESELLSCHAFT FUER VACUUMPHYSIK MBH (DE)

( * ) Notice: Subject to any disclaimer, the term of this patent is extended or adjusted under 35 U.S.C. 154(b) by 0 days.

(21) Appl. No.: 14/397,248

(22) PCT Filed: Apr. 23, 2013

(86) PCT No.: PCT/DE2013/100149

§ 371 (c)(1),
(2) Date: Feb. 16, 2015

(87) PCT Pub. No.: WO2013/159772

PCT Pub. Date: Oct. 31, 2013

(65) Prior Publication Data

US 2015/0159363 A1 Jun. 11, 2015

(30) Foreign Application Priority Data

Apr. 27, 2012 (DE) ..... 10 2012 103 719

(51) Int. Cl.
*E04C 3/00* (2006.01)
*E04H 1/02* (2006.01)
(Continued)

(52) U.S. Cl.
CPC ..... *E04B 1/34315* (2013.01); *E04B 1/2403* (2013.01); *E04B 1/3483* (2013.01);
(Continued)

(58) Field of Classification Search
CPC .... E04B 1/18; E04B 1/34315; E04B 1/34331; E04B 1/3483; E04B 1/2403; E04B 7/10; E04B 2001/2409; E04B 2001/2415; E04B 1/34326; E04H 1/02; E04H 1/005; E04H 1/1205; E04H 2001/1283; E04C 2003/0421; E04C 2003/043; E04C 2003/0439
See application file for complete search history.

(56) References Cited

U.S. PATENT DOCUMENTS 3,971,172 A * 7/1976 Gentil ..... 52/28
5,413,836 A * 5/1995 Hsieh ..... 428/188
(Continued)

FOREIGN PATENT DOCUMENTS

EP 1749948 A2 2/2007
WO WO2010/080072 A2 7/2010

OTHER PUBLICATIONS

International Search Report for PCT/DE2013/100149, dated Sep. 9, 2013, 2 pages.

*Primary Examiner* — Patrick Maestri
(74) *Attorney, Agent, or Firm* — Ware, Fressola, Maguire & Barber LLP

(57) ABSTRACT

The invention relates to a metallic frame structure of a container-like, modular and mobile housing, an assembly kit for such a housing, a container-like, modular and mobile housing, as well as a hollow profile for such a housing. The hollow profile which is designed as a floor main profile (1), roof main profile (2) and/or support profile (3) for the metallic frame structure, has a longitudinal structure (71, 72, . . . ) extending along the longitudinal direction of the profile and originating from an outer profile surface. The longitudinal structure is formed as a longitudinal elevation or longitudinal groove and has a width at its attachment to the
(Continued)

profile outer surface of less than 20, 15 or 10 millimeters in the direction transverse to the longitudinal direction of the profile.

16 Claims, 9 Drawing Sheets

(51) Int. Cl.

| | |
|---|---|
| ***E04B 1/343*** | (2006.01) |
| ***E04B 1/24*** | (2006.01) |
| ***E04B 1/348*** | (2006.01) |
| ***E04H 1/12*** | (2006.01) |
| ***E04H 1/00*** | (2006.01) |

(52) U.S. Cl.
CPC ..... *E04B 1/34331* (2013.01); *E04H 1/005* (2013.01); *E04H 1/02* (2013.01); *E04H 1/1205* (2013.01); *E04H 2001/1283* (2013.01)

(56) References Cited

U.S. PATENT DOCUMENTS

| | | | | |
|---|---|---|---|---|
| 6,832,580 | B2 * | 12/2004 | Marchioro | A01K 1/0245 119/452 |
| 2004/0074204 | A1 | 4/2004 | McKinnon | |
| 2005/0084324 | A1 * | 4/2005 | Dubensky | E04B 1/3483 403/305 |
| 2008/0053015 | A1 | 3/2008 | Matechuk | |
| 2008/0110127 | A1 * | 5/2008 | Terada et al. | 52/646 |
| 2011/0000146 | A1 | 1/2011 | Takeda et al. | |

* cited by examiner

METALLIC FRAME STRUCTURE, ASSEMBLY KIT FOR MOBILE HOUSING, MOBILE HOUSING AND HOLLOW PROFILE

CROSS REFERENCE TO RELATED APPLICATIONS

This application is a National Stage of PCT International patent application no. PCT/DE2013/100149, filed 23 Apr. 2013, which claimed priority in German patent application no. 10 2012 103 719.1, filed 27 Apr. 2012, the contents of these documents incorporated herein by reference.

TECHNICAL FIELD

The invention relates to the field of container-like, modular and mobile housing/housing units. Housing of this kind can refer in particular to residential containers, office containers or room modules. These serve as rooms for living and/or working at locations where they are required occasionally and temporarily. Examples include office containers for construction workers and construction engineers close to a building site and accommodation for aid workers and victims in disaster zones. The mobile housing unit must hereby have specific minimum dimensions in order to be able to hold the required articles and equipment for the relevant intended purpose, by way of example, bedroom and office furniture and the like. The housing unit must moreover be stable enough to withstand possible severe weather conditions and, where applicable, also to be stackable into a housing or working settlement.

BACKGROUND

One of the construction methods for office containers, which is commercially very successful and has a high acceptance rate, especially when used at building sites, is a sea-container-like modular structure which is widespread in Europe and especially in Germany. In recent years, there likewise seems to be a trend for using such modular structures in the Far East, in North America and elsewhere. Various designs are thereby available, from lightweight, favourably-priced construction methods up to heavy and higher-quality constructions that meet the highest safety standards. They offer good heat insulation and meet the requirements of the building regulations in most developed countries.

There are, however, drawbacks which are connected to the manufacture, transport and handling of such large, modular units. In particular, the manufacture of the conventional container frame is very labour-intensive and requires extensive welding work and a lot of surface finishing work such that the production can take up a lot of time. Furthermore, the size and the width of such modules are, as a rule, limited to the height and width of a transport vehicle, which makes covering large distances (more particularly in the case of transport overseas) impractical and expensive for larger structural units. The loading and unloading of conventional office containers, even in collapsed form, also furthermore requires special equipment such as cranes and forklift trucks. Because of the low production rate and the restricted transport possibilities, a sudden high demand cannot readily be met, as, by way of example, in the event of natural disasters.

SUMMARY OF THE INVENTION

It is the object of the invention to provide a mobile housing unit, a frame structure and an assembly kit for this, as well as a corresponding hollow profile for the frame structure, which can be manufactured cost-effectively and can be supplied at short-term notice. In particular, such housing units should be characterized by short-term availability and a simple, intermediate storage.

This is achieved, in accordance with the invention, by a metallic frame structure of a container-like, modular and mobile housing unit, more particularly a residential container, an office container or a room module, comprising horizontal main floor profiles which are connected detachably to one another to form a floor frame. Horizontal main roof profiles are connected detachably to one another to form a roof frame. Vertical support profiles are each connected detachably to the main floor profiles of the floor frame by means of a floor corner connection and to the main roof profiles of the roof frame by means of a roof corner connection so that the floor frame and the roof frame are connected together parallel and at a vertical distance from one another. The support profiles are designed and arranged so that when stacking two or more frame structures on top of each other, the frame structure stacked on top is supported mainly by means of the vertical support profiles. At least one of the main floor profiles, the main roof profiles and/or the support profiles is a hollow profile of metal which has a longitudinal structure extending along the longitudinal direction of the profile and originating from an outer profile surface, which longitudinal structure is designed as a longitudinal elevation or longitudinal groove and has a width of less than 20, 15 or 10 millimeters at its origin at the outer profile surface in the direction transverse to the longitudinal direction of the profile. Further advantageous refinements of the invention are provided in the dependent claims.

The invention is based on the idea of providing a system of profiles for the assembly of a mobile housing unit, wherein the profiles are first assembled in a simple and secure way into a frame structure for the housing unit. This frame structure can then be conjoined by additional wall, roof and floor elements in order to form the complete housing unit. The profiles are connectable-detachable, in particular by means of plug-in/slot-in, clamp, and/or screw connections. The otherwise conventional welding work that is usually necessary during assembly is hereby avoided. In this way, the assembly costs and the assembly times of such housing units could thus be reduced. In addition, a short-notice availability, a simple, intermediate storage, as well as an application of such housing units for various purposes would become possible.

The devices described herein have a series of advantages based on the use of profiles having longitudinal structures that can be configured in any way. They can offer a uniform and systematic method of construction for relatively stable and strong frame structures of metal that are transportable and stackable. They permit a simple assembly, a construction that is flexible according to size, and high mobility, as well as an efficient assembly and dismantling. They allow numerous functionalities, based on the wide variety of possible designs for the longitudinal structures, a rapid manufacturing process, the use of sustained manufacturing processes, low production costs, and ease of storage, packing, transporting, handling, maintenance and repair. Furthermore, the use of many standard types of floor, roof and wall elements is made possible.

Because of the longitudinal structuring of the profiles, a higher rigidity and bending resistance can be obtained, so that, in turn, metal profiles with a reduced wall thickness can be used. In this way, the weight and the costs can be kept low.

The container-like, modular and mobile housing unit is an inherently closed, modular, self-supporting building which is transportable and can be used as a temporary office, as living space, or as an emergency shelter. Such a housing unit is similar in shape and size to a conventional sea container. It has, however, an essentially lighter frame construction, which, as a rule, has to be built according to binding construction regulations. Such modular housing units can be combined and/or stacked to erect two-, three- or higher-storied buildings. What differentiates such container-like modular buildings from other types of modular constructions is, in particular, the construction of the frame, which provides the office container with its characteristic container shape. The metallic frame structure, and thus also the mobile housing unit formed therefrom, preferably has a length of at least 2, 3, 4, 5 or 6 meters, a width of at least 1, 1.5 or 2 meters and/or a height of at least 1, 1.5, 2 or 2.5 meters. It is particularly preferred if the housing unit has the dimensions of a 20-foot or a 40-foot ISO container. In preferred embodiments the mobile housing unit can have a width of up to 3 meters, a length of up to 10 or 13 meters and/or a height of up to 3 meters, where applicable in combination with one of the previously mentioned dimensions.

The metallic frame structure comprises a lower floor frame, an upper roof frame and vertical supports, more particularly four such supports along vertical edges of the frame structure which connect the floor and roof frames to one another. The preferably rectangular floor frame is formed from horizontal main floor profiles, which are connected detachably to one another. The preferably rectangular roof frame is accordingly formed from horizontal main roof profiles, which are connected detachably to one another. Main floor profile and main roof profile can also be termed floor support and roof support respectively, whilst the vertical supports or support profiles can be termed vertical supports.

The vertically arranged support profiles connect the floor frame to the roof frame in a parallel arrangement at a vertical distance from one another, by means of a detachable connection. A rigid connection between the two frames is preferably formed by means of the support profiles. The support profiles are designed and arranged so that when stacking two or more frame structures, or when stacking two housing units, each comprising one such frame structure, one additionally stacked frame structure or housing unit is mainly supported by means of the vertical support profiles. In other words, the supporting of an upper frame structure is essentially undertaken by means of the support profiles of the lower frame structure only. The load distribution is thus undertaken hardly or even not at all, for example, by way of wall elements, which complete the housing unit, but which themselves do not have to take up or transfer any forces.

Each support profile forms a floor corner connection by means of the adjoining main floor profiles of the floor frame, and a roof corner connection by means of the adjoining main roof profiles of the roof frame. These corner connections not only play an important role in the connection of the horizontal and vertical main supports, i.e. the main frame profiles, the main roof profiles and the support profiles. But they also form the fixing points, by way of example during lifting by means of a crane. Several housing units or frame structures can also be connected securely to one another or fixed to each other at their corners. Furthermore, in advantageous embodiments, the inlet and outlet points for rainwater are located at these corners.

At least one of the main floor profiles, main roof profiles and/or support profiles is a hollow profile of metal that has a longitudinal structure extending along the longitudinal direction of the profile and originating from an outer profile surface, said longitudinal structure being formed as a longitudinal elevation or longitudinal indentation, or longitudinal groove, and having at its origin on the outer profile surface, transverse to the longitudinal direction of the profile, a width of less than 20, 15 or 10 millimeters. The hollow profile can have, in part or in whole, a round, circular, oval, square, rectangular and/or polygonal cross section. That the longitudinal structure is formed starting from an outer profile surface means that it projects inwards or outwards, geometrically considered, from a periphery of the cross section of the hollow profile. The longitudinal structure originates at the periphery of the cross section and has along the periphery, and thus transversely or perpendicular to the longitudinal direction of the profile, a maximum extension of 10, 15, or 25 millimeters. If the longitudinal structure projects inwards from the origin along the periphery of the hollow profile cross section, it is a longitudinal indentation, or longitudinal groove, thus a groove that extends along the longitudinal direction of the profile. On the other hand, it is said to be a longitudinal elevation, thus an elevation of the hollow profile along the longitudinal direction of the profile, when the longitudinal structure projects outwards from its origin on the periphery of the hollow profile cross section.

The longitudinal structures dealt with here moreover each have a height, thus an extension perpendicular to the surface of the hollow profile measured from the origin or from the periphery of the hollow profile cross section inwards or outwards, of at least 5, 10, 15, 20 or 25 millimeters or more. This means that the longitudinal structure projects at least by as much as this height from the periphery of the cross section of the hollow profile, inwards in the case of a longitudinal groove, or outwards in the case of a longitudinal elevation.

The longitudinal structure creates mounting opportunities for detachable connections of elements with the hollow profile. In particular, the floor corner connection and/or the roof corner connection can be formed by means of the longitudinal structure. A longitudinal structure in the form of a longitudinal elevation on the support profile can serve as a contact-bearing surface for placing the main floor profile and/or the main roof profile during assembly. The longitudinal elevation can furthermore allow a bore to be made through the same in order to form a screw connection between the profiles that are to be connected to one another.

Additional elements and connection parts can be provided as part of the floor corner connection and/or roof corner connection. In special embodiments, stacking elements or stacking plates are provided which close off the support profiles at the top and/or at the bottom. They form bearing surfaces in order to spread the load of frame structures or housing units stacked one on top of the other to the relevant support profiles which are located underneath. Furthermore, reinforcing elements can be provided in the form of reinforcing inserts or reinforcing sleeves, which are pushed into hollow profiles at the connections as guide elements both in order to facilitate the assembly and also to stabilize the connections themselves.

Angle elements and fastening brackets can also be provided in order to strengthen the floor corner connection and/or the roof corner connection. By way of example, a fastening bracket of this type at a corner connection can fix exclusively or additionally two main floor profiles or two main roof profiles that abut the support profile.

The hollow profile with the longitudinal structure can be formed in low-priced embodiments from an extruded aluminum profile. Using the method of extrusion allows very complicated profile structures to be made in practically any length.

In order, however, to produce hollow profiles with higher stability and bearing strength, it is advantageous to make these from sheet metal, more particularly from steel sheet. For this, the hollow profile with the longitudinal structure is formed from a one-, two-, or several-piece(d) metal sheet, preferably steel sheet, which is bent and is welded along the longitudinal direction of the profile, wherein the longitudinal structure originating from the outer profile surface is formed by means of bending. Instead of welding, other methods of connection can also be used as an alternative to close the bent sheet metal along the longitudinal direction of the profile, so that a hollow profile is formed. The sheet metal preferably has a thickness of at least 1, 2, 3 or 4 millimeters; however, the preferable thickness of the sheet metal is between 2 and 5 millimeters.

Welding the bent sheet metal along the longitudinal direction of the profile can considerably increase the bending resistance and strength of the profile, particularly in the event of pressure along the longitudinal direction of the profile.

The bending of the sheet metal can be carried out in the case of simple profile structures by means of a break press. However, the hollow profiles having complex longitudinal structures, which herein are advantageously utilized exclusively, are necessarily manufactured by means of roll profiling or with other suitable methods. The roll forming or cold roll forming of profiles, a continuous bending process in which strips of sheet metal are gradually formed by a number of pairs of rollers into the desired cross section, makes it possible to produce hollow profiles with longitudinal structures of practically any length, as explained above and in the following. The profiles with longitudinal structures explained above can be produced by means of roll forming at a considerably higher speed and thus with a considerably higher throughput than with press braking. By way of example, a complete set of profiles for a frame structure, comprising support, floor and main roof profiles as well as secondary profiles, can be produced within 5 to 10 minutes. These profiles can then be fitted and/or screwed together to form a frame structure within one or two hours. The assembly of conventional office containers, wherein the profiles have to be connected by welding, can take up to 6 to 8 work hours.

The longitudinal structure in the form of a longitudinal elevation can involve folding, doubling or rebating the metal sheet. In this case, the width of the longitudinal structure at its origin is only approximately double the thickness of the metal sheet, and the metal on one side of the fold contacts the metal on the other side of the fold. Such a fold, or longitudinal elevation, in which a distance between the two metal sides of the longitudinal elevation is in the millimeter region, can, for example, be easily drilled through in order to enable a screw connection, which can be placed anywhere along the longitudinal direction of the profile.

When viewing the cross section of the hollow profile, the longitudinal structure preferably has a finger-shaped, triangular-, rectangular-, square-, T-shaped, dovetail-shaped or circular-shaped cross-section. The longitudinal structure preferably gradually widens out from where it originates. This means that the longitudinal structure has along the periphery of the hollow profile a smaller width (equal to the width at its origin) than farther away from the periphery. This is particularly advantageous in the case of a longitudinal groove, which can then receive a sliding block or slot nut that can be moved in any way in the longitudinal groove along the longitudinal direction of the profile. If the slot nut has a threaded bore, a screw connection can hereby be produced which can be placed variably along the longitudinal direction of the groove. In other words, the longitudinal structure of the hollow profile is presented in such embodiments as a longitudinal groove into which a slot nut with an internal thread is placed, wherein a screw connection is formed by means of the sliding nut, by means of which screw connection one of the main floor profiles, main roof profiles and/or support profiles is detachably connected to another of the main floor profiles, main roof profiles and/or support main profiles. As described in the following, a screw connection of this kind can also serve to fasten other elements, such as secondary floor profiles or secondary roof profiles, onto the main floor profiles and/or main roof profiles, respectively.

As explained previously in connection with the support profile, in an expedient embodiment it is intended that, as a longitudinal elevation or longitudinal groove, the longitudinal structure of the hollow profile is formed in such a way that it forms a guide edge for positioning a section of one of the main floor profiles, main roof profiles and/or support profiles. The guide edge, which extends along the longitudinal direction of the profile, can hereby be formed on a first main floor profile, main roof profile and/or support profile in order to enable the guided positioning of a second profile which is to be connected to the first profile. This guide edge supports and assists the secure connection and serves, furthermore, as a guide element when arranging the profiles that are to be connected.

It is especially preferred that the hollow profile has two longitudinal structures which are formed as longitudinal elevations and which form between them a longitudinal channel, more particularly a C- or U-shaped longitudinal channel. In certain embodiments, the longitudinal channel receives in the frame structure a section of an additional profile. By way of example, the longitudinal channel can be formed on the support profile and receive the end or the side of a floor and/or main roof profile. Alternatively, or additionally, the longitudinal channel can be formed as a rain gutter and/or drainage channel. Finally, the longitudinal channel can in advantageous embodiments serve to receive wall, floor or roof elements. A C- or U-shaped longitudinal channel can also be formed by means of only one longitudinal elevation in the present sense, which forms one boundary of the longitudinal channel. In this case, the further boundary of the longitudinal channel is formed by means of an angled edge, by way of example a 90-degree angled edge.

The hollow profile can, according to requirements in advantageous embodiments, have at least two, three, four or five longitudinal structures, which are each formed as a longitudinal elevation or longitudinal groove. By way of example, the support profiles can have four longitudinal elevations which each form in pairs a longitudinal channel for guiding the floor and main roof profiles. The main floor profiles can, in turn, have, by way of example, two triangular or T-shaped longitudinal grooves, in which slot nuts with threaded bores are arranged, as well as one longitudinal channel for receiving wall elements and one longitudinal indentation, or longitudinal groove, for receiving floor elements. Finally, the main roof profiles can each have one or two longitudinal grooves in which slot nuts with threaded bores are arranged, one longitudinal channel for receiving wall elements and one longitudinal channel lying opposite this for a rain gutter, and each can have one longitudinal elevation in the form of a fold for holding a roof element.

In preferred embodiments of the frame structure, the housing unit and the assembly kit, respectively, the main floor profiles each have one or two longitudinal grooves and one or two longitudinal elevations, the main roof profiles each have one or two longitudinal grooves and one or two longitudinal elevations, and the support profiles each have two, three or four longitudinal elevations.

In a further advantageous embodiment, it is proposed that secondary floor profiles which are each arranged between two parallel main floor profiles and are connected detachably to the two parallel main floor profiles, and/or secondary roof profiles which are each arranged between two parallel main roof profiles and are connected detachably to the two parallel main roof profiles, wherein the secondary floor profiles are supported or mounted by means of the longitudinal structures of the main floor profiles and/or the secondary roof profiles are supported or mounted by means of longitudinal structures of the main roof profiles. The secondary roof profiles form a part of the roof frame and provide horizontal reinforcement. Furthermore, they offer additional bearing surfaces for roof elements or for a roof cladding, which can be mounted hereon, in order to close the housing unit at the top. Similarly, the secondary floor profiles form a part of the floor frame and provide horizontal reinforcement. Floor elements can be arranged on the secondary floor profiles in order to close the housing unit at the bottom and to make the interior space accessible. If the ground surface of the frame structure or housing unit is rectangular, that is, if two of the main floor profiles and main roof profiles respectively are longer than the other two, then the secondary floor profiles and secondary floor profiles respectively are preferably mounted on the longer main floor profiles and main roof profiles, respectively.

According to an expedient configuration, it is proposed that the longitudinal structure of the hollow profile is formed as a longitudinal groove in which a slot nut with an inner thread is arranged, wherein by means of the slot nut a screw connection is formed by means of which the secondary profiles are connected detachably to the main floor profiles and/or main roof profiles. The longitudinal groove is thus formed on one or more of the main floor profiles and/or main roof profiles, preferably along the longer main floor profiles and main roof profiles, respectively. More expediently, the hollow profile has two longitudinal grooves running parallel side by side and which can be used to fix the secondary profile more securely on the hollow profile by means of two screw connections.

In a preferred embodiment, it is proposed that the longitudinal structure of the hollow profile is designed as a longitudinal groove in which a holding section or insert element of the secondary profiles engages in order to form slot-in connections between the hollow profile and the secondary profiles.

In a simple configuration, the secondary floor profiles are formed as open C- or I-profiles. It is particularly preferred, however, that the secondary floor profiles are each formed as a hollow profile from a metal sheet, preferably steel sheet, bent in one piece, two pieces or several pieces. The sheet metal can preferably be welded along the longitudinal direction of the profile in order to offer a robust hollow profile structure. The secondary floor profiles can be fixed to the main floor or roof profiles by means of screw connections. Alternatively or additionally, a section or an insert element of a secondary floor profile can engage in a longitudinal groove of the main floor or roof profile, respectively, preferably with a form-fitting engagement so that a slot-in or clamping connection is produced.

The metallic frame structure described herein in all its possible embodiments can be used to form a container-like, modular and mobile housing unit, more particularly a residential container, an office container or a room module. For this, wall elements, roof elements and floor elements are positioned on the frame structure and, together with the frame structure, enclose an interior area of the housing unit. The wall elements, roof elements and/or floor elements can have, in particular, thermal insulation means and they can preferably be fire-resistant. Furthermore, one or more of these elements can have openings for doors, windows, ventilation and the like.

In a preferred embodiment, it is proposed that the wall elements, roof elements and/or floor elements are each positioned on longitudinal elevations and/or in longitudinal grooves of the main floor profiles, main roof profiles and/or support profiles. Preferably, some or all of the main floor profiles, some or all of the main roof profiles and/or some or all of the support profiles have on their sides, facing away from the interior of the housing unit, folded rebates which run parallel to the wall elements, roof elements and/or floor elements and thus cover the supporting edges or joints of these elements on the associated profiles.

The metallic frame structure or the container-like, modular and mobile housing unit with the frame structure is preferably supplied in the form of an assembly kit. This assembly kit thus comprises the main floor and roof profiles either separately or with floor frame or roof frame preassembled, as well as the support profiles. The assembly kit can be stored and easily transported in a space-saving manner in a collapsed state.

BRIEF DESCRIPTION OF THE DRAWINGS

The invention will now be explained below by means of exemplary embodiments with reference to the drawings. These show.

DETAILED DESCRIPTION OF THE INVENTION

Figure 1:
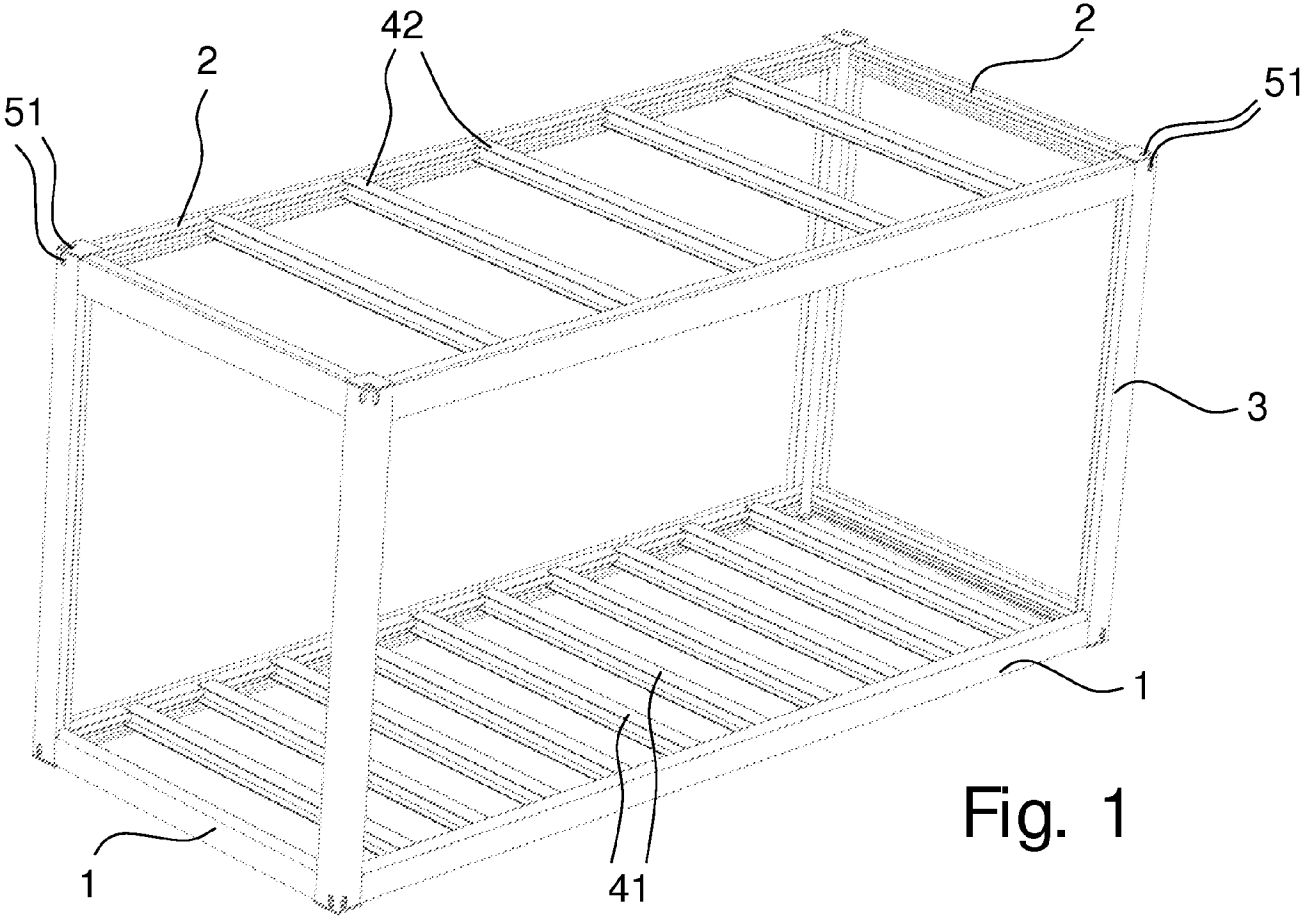
FIG. 1 a perspective view of the frame structure according to a preferred embodiment.

FIG. 1 shows a perspective view of a frame structure for a mobile housing unit, more particularly for an office container, a residential container or a room module. The frame structure has a box-like construction with a floor frame and a roof frame that are connected to one another by way of the support profiles 3. The floor frame is formed from four main floor profiles 1, connected to one another by the support profiles 3, and from a number of secondary floor profiles 41 that are arranged between and mounted on the two longer main floor profiles 1. Four main roof profiles 2 connected to one another by way of the support profiles 3, and a number of secondary roof profiles 42 form the roof frame in a similar way.

The main floor profiles 1 are connected detachably to the support profiles 3 at floor corner connections, whilst the main roof profiles 2 are connected to the support profiles 3 at roof corner connections. These corner connections form essential elements of the present frame structure and will be explained more precisely below. Furthermore, several lift and holding bores 51 are provided at the corners of the frame structure and these bores serve to connect the frame structure to one or more additional frame structures. An additional frame structure can be stacked, by way of example, on top of the frame structure. The load of the additional frame structure is hereby preferably taken up, in essence, entirely by the four support profiles 3 of the frame structure, so that no vertical force presses on the main floor profiles 1 or the main roof profiles 2 as a result of stacking. The frame structure of FIG. 1 can be completed with wall, roof and floor elements in order to form the completed housing unit.

Figure 2:
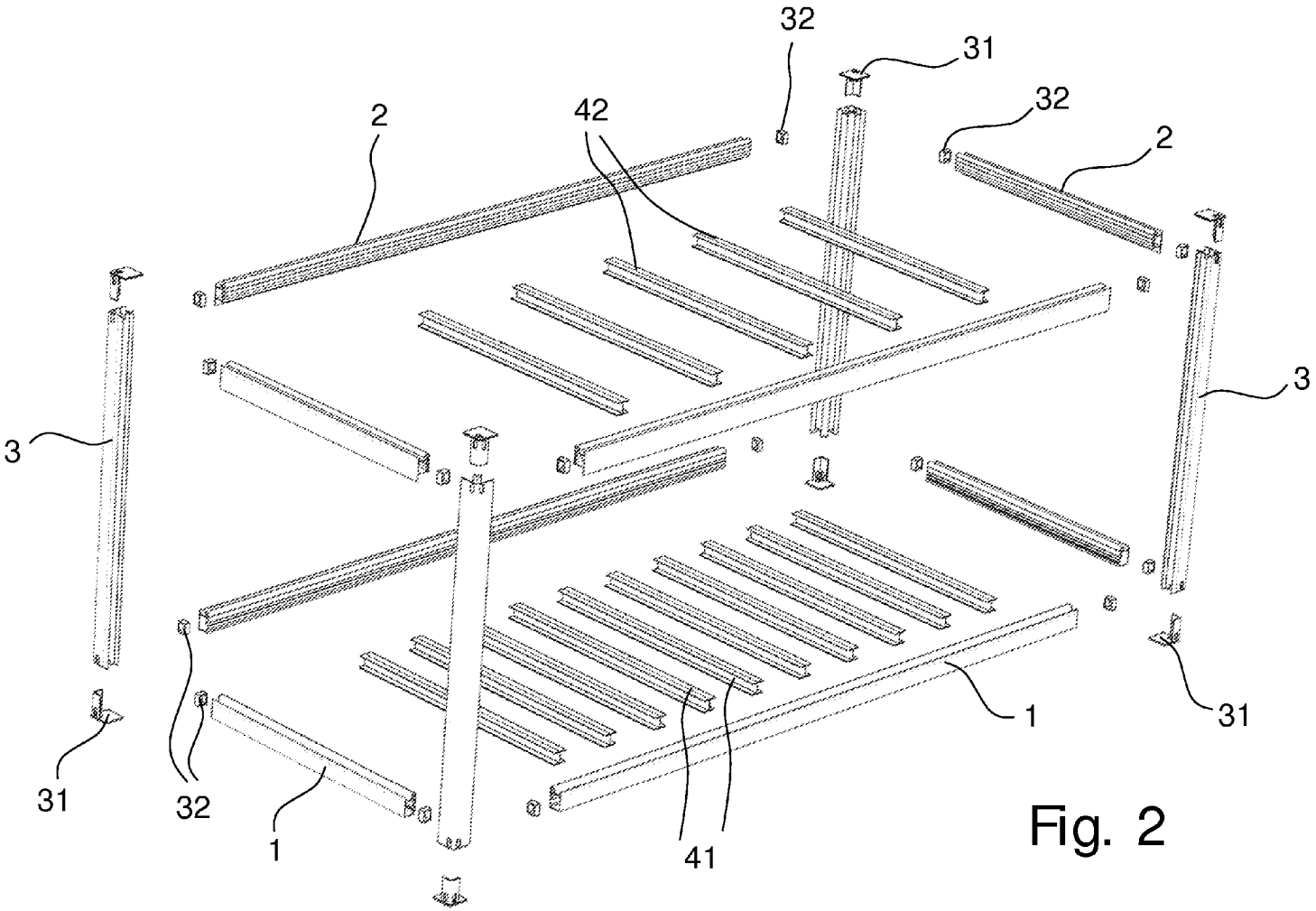
FIG. 2 an exploded view of the frame structure of FIG. 1.

FIG. 2 is an exploded view of the frame structure of FIG. 1. Here it can be seen that the support profiles 3 are each closed on each side with stacking plates 31. A stacking plate 31 serves on the one hand to protect the inside of the associated support profile 3 from dirt and water. In addition, it offers a bearing surface for a further frame structure stacked on top of the frame structure. Furthermore, in FIG. 2 reinforcing sleeves 32 are shown which are inserted at the ends of the main floor profiles 1 and the main roof profiles 2 into the main floor profiles 1 and into the main roof profiles 2, respectively, and thus reinforce the respective corner connection.

As can be seen from FIGS. 1 and 2, the secondary floor profiles 41 and the secondary roof profiles 42 are I-profiles, also called double-T-supports or double-T-profiles. Alternatively, other types of profiles can also be used, more particularly profiles of sheet metal, preferably of steel sheet, which is bent and welded preferably along a longitudinal direction to form hollow profiles.

Figure 3:
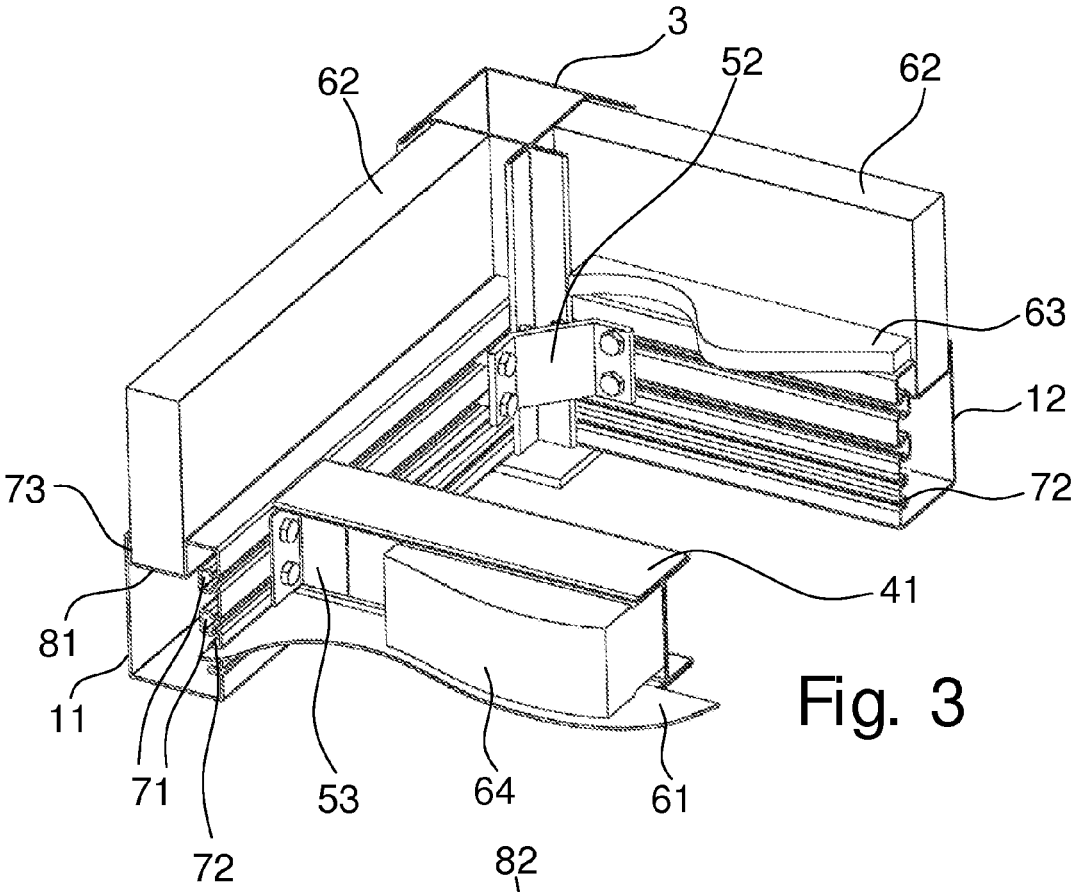
FIG. 3 a floor corner connection of a frame structure with wall and floor elements and a secondary floor profile, according to a preferred embodiment.
Figure 4:
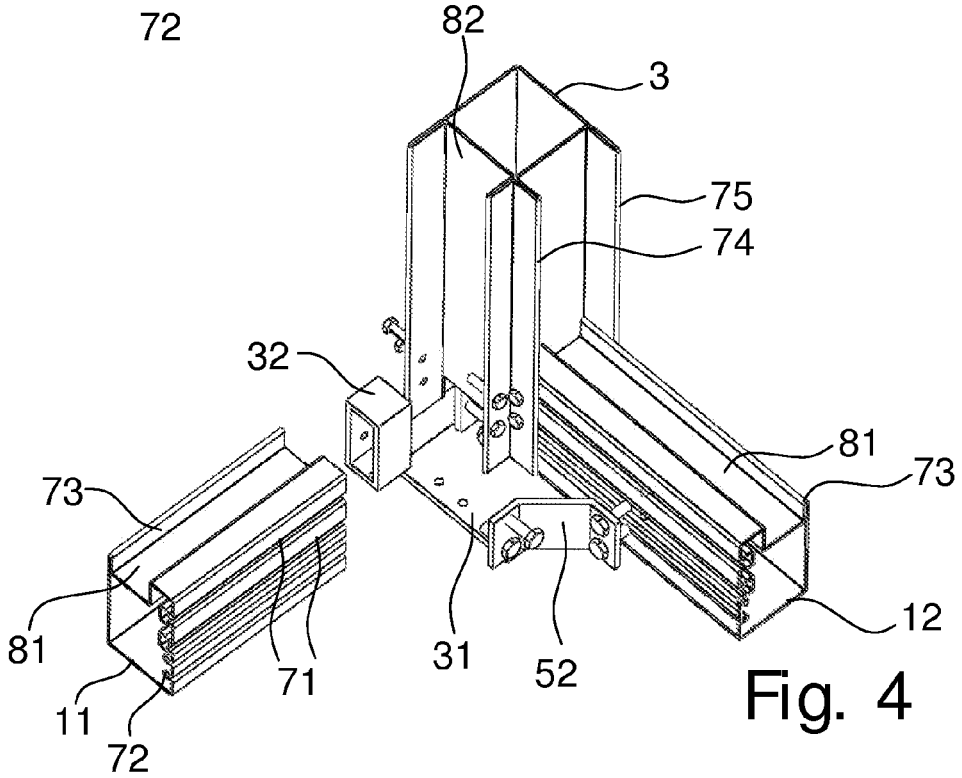
FIG. 4 an exploded partial view of the floor corner connection of FIG. 3 without wall and floor elements and secondary floor profile.

One possible implementation of a floor corner connection is shown in FIGS. 3 and 4, wherein FIG. 3 is a three-dimensional sectional drawing, and FIG. 4 is an exploded illustration of the floor corner connection. The connection of two main floor profiles 11, 12 which meet at the support profile 3 is formed by way of the support profile 3. The main floor profiles 11, 12 are comprised of a long main floor profile 11 extending along the length of the frame structure and a short main floor profile 12 of the floor frame extending along the width of the frame structure. Achieved by means of bending, the support profile 3 exhibits a substantially box-shaped cross section and four longitudinal structures 74, 75 in the form of folds, or rebates, of the metal sheet. Each of two longitudinal structures 74, 75 form the boundaries of a longitudinal channel 82 along the profile longitudinal direction of the support profile 3. The front ends of the main floor profiles 11, 12 are inserted into these longitudinal channels 82 and fixed by means of screws. The screws are hereby pushed through bores in the longitudinal structures 74, 75. The front ends of the main floor profiles 11, 12 adjoining the support profile 3 are reinforced by means of inserted reinforcing sleeves 32 in order to avoid any undesired profile bending there. The support profile 3 is closed at the bottom by a stacking plate 31, which also offers a guide-positioning surface for the ends of the main floor profiles 11, 12.

The two main floor profiles 11, 12 have substantially the same cross sections. Their cross sections are rectangular and each has four longitudinal structures 71, 72, 73. Two of the longitudinal structures 71 are designed as longitudinal grooves with T-shaped cross sections, with a narrow neck at their origin at the outer surface of the profile, and an expansion extending from there into the inner region of the hollow profile. Slot nuts with internally threaded bores that are capable of receiving screws are inserted into these longitudinal grooves 71. They serve on the one hand to connect the two main floor profiles 11, 12 directly to one another in the region of the floor corner connection by means of a corner fixing element 52, and at the same time to press these against the support profile 3. The floor corner connection is thus secured and strengthened by means of the corner fixing element 52, which extends across the support profile 3 between the two main floor profiles 11, 12.

Furthermore, the two parallel longitudinal structures 71 with the slot nuts arranged therein offer the possibility of arranging secondary floor profiles 41, distributed along the longitudinal direction of the profile, and of fixing them to the main floor profile 1, 11. In the embodiment according to FIGS. 3 and 4 this is achieved for each secondary floor profile 41 by means of an angle fixing element 53, which is screwed, riveted, welded or fixed in another way on the secondary floor profile 41, and is screwed onto slot nuts in the longitudinal structures 71. The secondary floor profiles 41, of which only one is shown in FIGS. 3 and 4, are here fixed on the long main floor profile 11.

An additional longitudinal structure 72 in the form of a longitudinal groove is arranged underneath the two aforementioned longitudinal structures 71 and receives an edge of a floor cladding 61, which closes the housing unit at the bottom. The floor cladding 61 comprises several segments, each of which rests on the lower horizontal surface of adjacent secondary floor profiles 41. Insulation elements 64 are arranged on the floor cladding 61 and are inserted in recesses of the secondary floor profiles 41. Finally, a floor element 63 is provided as the ground floor of the housing unit. The floor element 63 lies on the upper edges of the main floor profiles 11, 12 and the secondary floor profiles 41.

An additional longitudinal structure 73 protrudes at the outer edges of the main floor profiles 11, 12. This longitudinal structure 73 forms a boundary of a longitudinal channel 81 along each main floor profile 11, 12 and serves to receive the wall elements 62. The wall elements are thus framed all around on their outside surfaces facing away from the interior of the housing unit by outer longitudinal structures 73, 75 which are formed as folds on the main floor profiles 11, 12 and the support profile 3. The floor cladding 61, the wall elements 62, the floor element 63 and the insulation element 64 of FIG. 3 are not shown in the exploded view of the frame structure in FIG. 4 for reasons of clarity.

Figure 5:
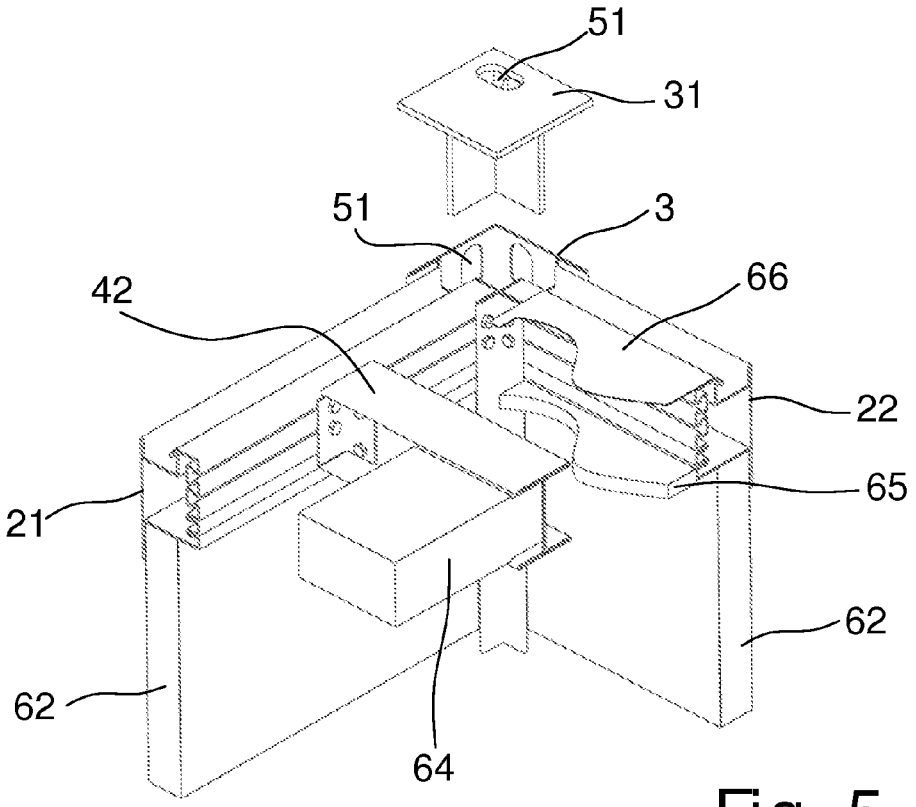
FIG. 5 a roof corner connection of a frame structure with wall and roof elements and a secondary roof profile, according to a preferred embodiment.
Figure 6:
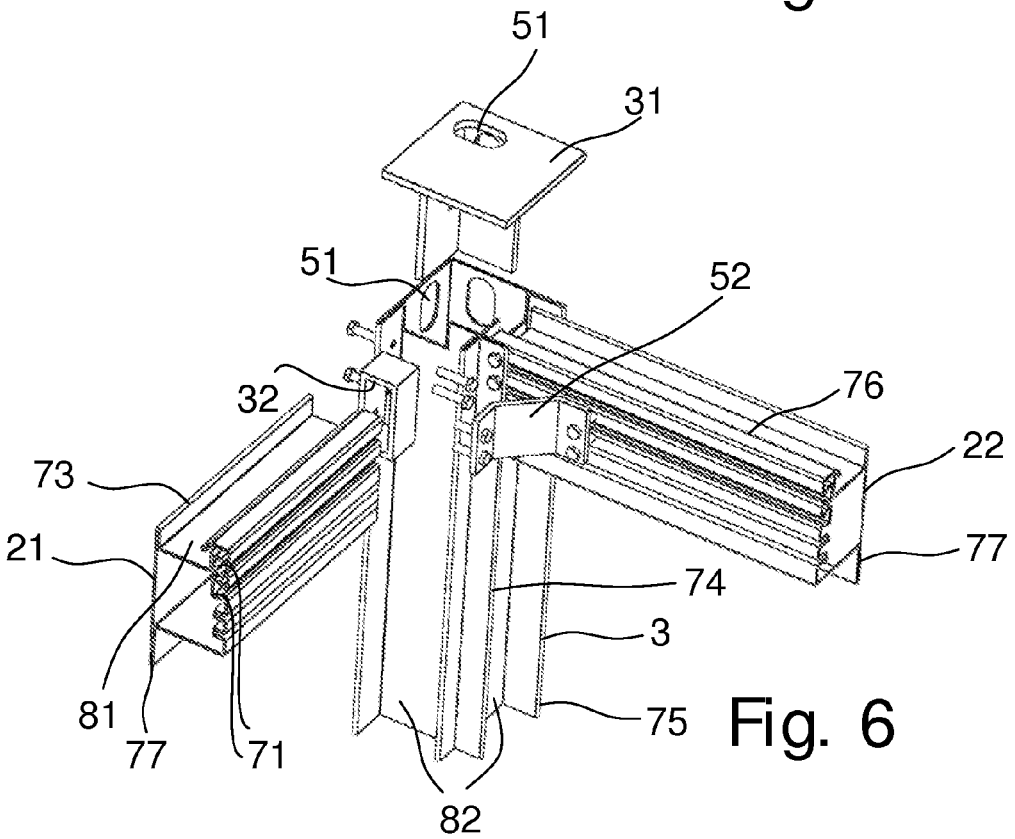
FIG. 6 an exploded partial view of the roof corner connection of FIG. 5 without wall and roof elements and secondary roof profile.

The roof corner connection corresponding to FIGS. 3 and 4 is shown in FIGS. 5 and 6 as a three-dimensional sectional drawing in FIG. 5 and as an exploded view in FIG. 6. This is hereby the same support profile 3 as shown in FIGS. 3 and 4. This is likewise closed at the top by means of a stacking plate 31. In FIGS. 5 and 6 lift and holding bores 51 are moreover visible in the stacking plate 31 and in the support profile 3 and can be used to connect together several frame structures which are arranged side by side and/or stacked one above the other.

End faces of two main roof profiles 21, 22 are now inserted and fixed by means of screws in the two longitudinal channels 82 formed by means of the longitudinal structures 74, 75 along the support profile 3, in a similar way to the main floor profiles 11, 12. The long main roof profile 21 and the short main roof profile 22 are configured in their cross section similar to the main floor profiles 11, 12 of FIGS. 3 and 5. They likewise have two parallel longitudinal structures 71 in the form of longitudinal grooves suitable for receiving slot nuts, and their adjoinment to the support profile 3 is likewise strengthened by means of reinforcing sleeves 32 and a corner fixing element 52, which is, however, not shown in FIG. 5 for reasons of clarity.

The longitudinal structure 73 at the outer upper edges of the main roof profiles 21, 22 likewise fulfills a similar function, as in the case of the main floor profiles 11, 12, in that they each form an outer boundary of a longitudinal channel 81. However, unlike the longitudinal channels 81 in the main floor profiles 11, 12, the longitudinal channels 81 in the main roof profiles 21, 22 do not serve to receive wall elements, but preferably serve as rain gutters or as drainage channels. The support profile 3 has, accordingly, at the upper end of the extension of the longitudinal channels 81 recesses through which rainwater or waste water can flow out and then down from the longitudinal channels 81 into the hollow profile of the support profile 3.

A secondary roof profile 42, a roof interior cladding 65, a further insulation element 64 and a roof element 66 and roof outside cladding 66, respectively, are shown attached in the upper region of the housing unit to the main roof profiles 21, 22, corresponding to the arrangement of the secondary floor profile 41, the floor element 63, the insulation element 64 and the floor cladding 61 in the lower region of the frame structure on the main floor profiles 11, 12. The outside roof cladding 66 is hereby folded over a longitudinal structure 76, which is in the form of a fold or a rebate, which is inclined towards the longitudinal channel 81. In this way, it is ensured that the roof outside cladding 66 is spanned over the interior space of the housing unit and prevents the penetration of rainwater. Thus, rain water striking the roof outside cladding 66, or melting water from snow lying on the outside roof cladding 66, is directed into the longitudinal channels 81, serving as rain gutters, and from there into the support profiles 3. The longitudinal structure 76 is hereby inclined in the direction of the longitudinal channel 81 in order to facilitate the flow of water from the roof outside cladding 66 into the longitudinal channel 81.

Furthermore, the main roof profiles 21, 22 each have along their outer side, facing away from the interior space of the housing unit, a further longitudinal structure 77 extending downwards in the form of a fold. This serves as a contact-bearing surface of the wall elements 62 and, together with the longitudinal structures 73 of the main floor profiles 11, 12 and the outer longitudinal structures 77 of the support profile 3, makes up the peripheral frame of the wall element 62 explained above.

The longitudinal structures furthermore increase the bending resistance of the main roof profiles 21, 22. Other longitudinal structures of the main roof profiles 21, 22, shown in FIGS. 5 and 6, serve to further increase the bending resistance.

Figure 7:
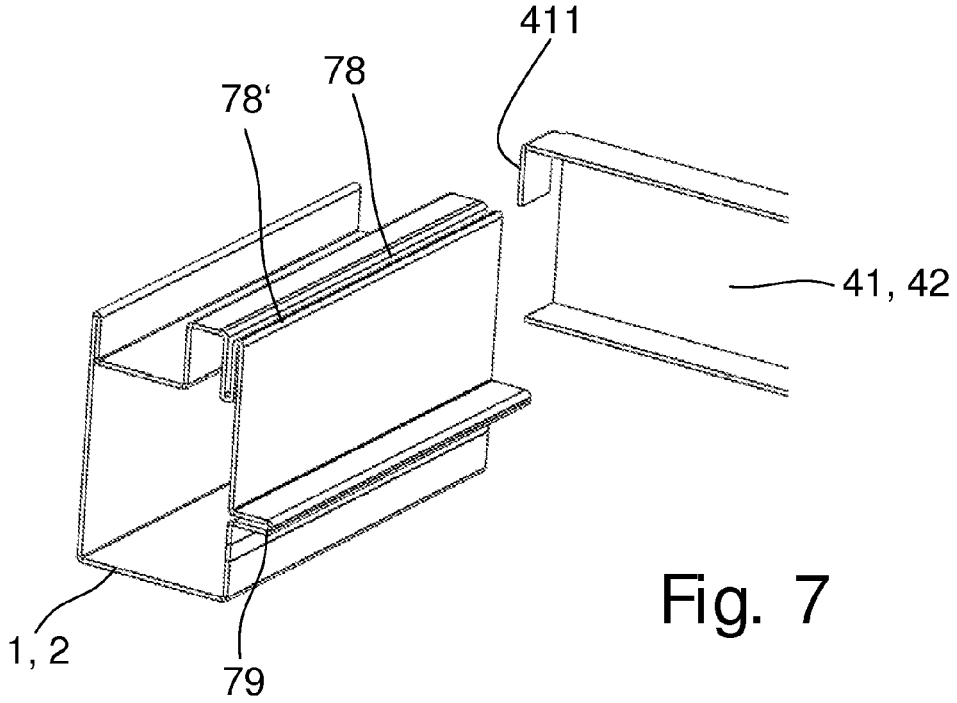
FIG. 7 a floor or main roof profile and an associated secondary profile.
Figure 8:
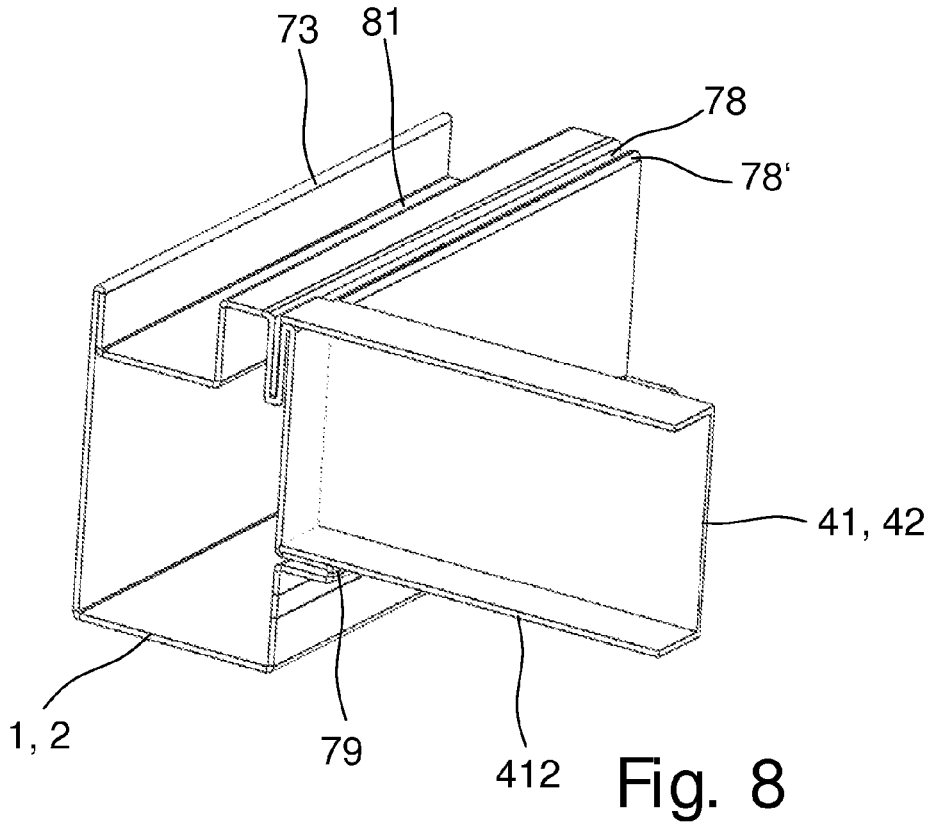
FIG. 8 the profiles of FIG. 7 which are connected by means of a slot-in connection.
Figure 9:
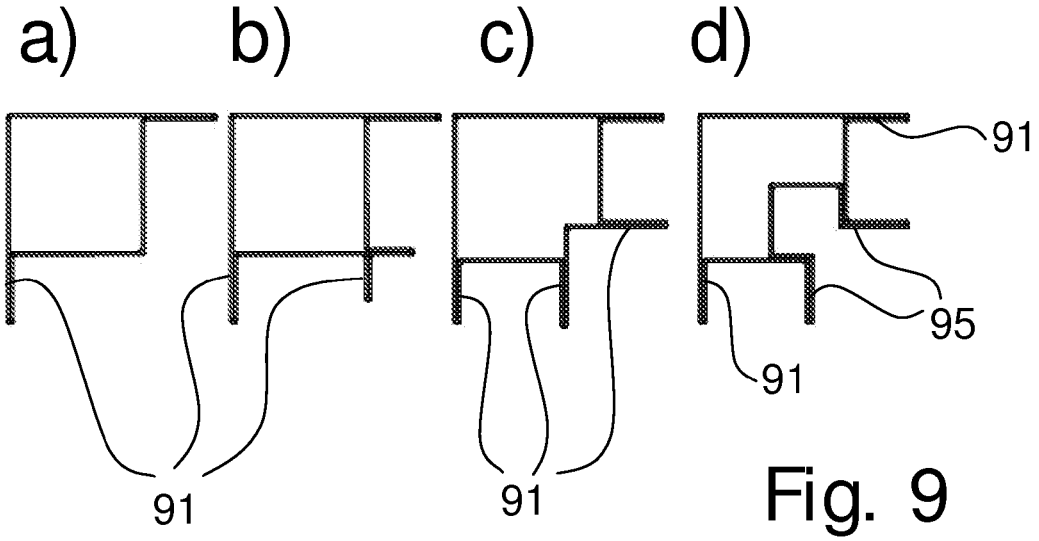
FIG. 9 different preferred configurations of a support profile in a cross-sectional view.
Figure 10:
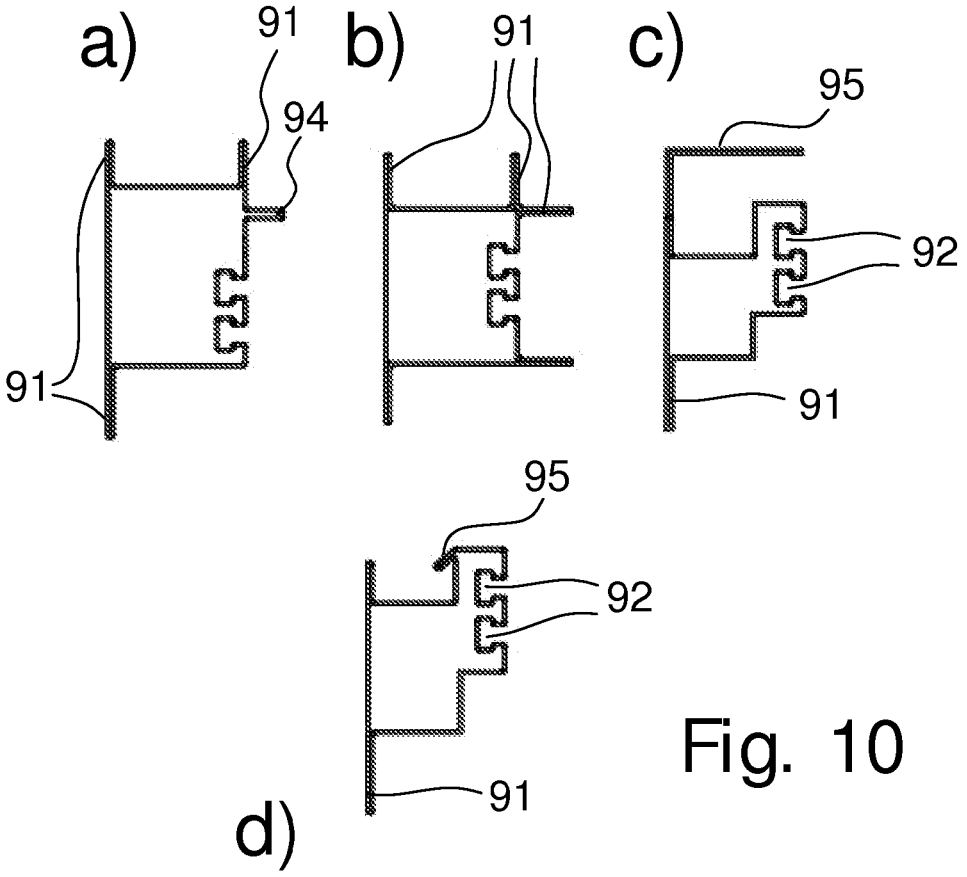
FIG. 10 different preferred configurations of a main roof profile in a cross-sectional view.
Figure 11:
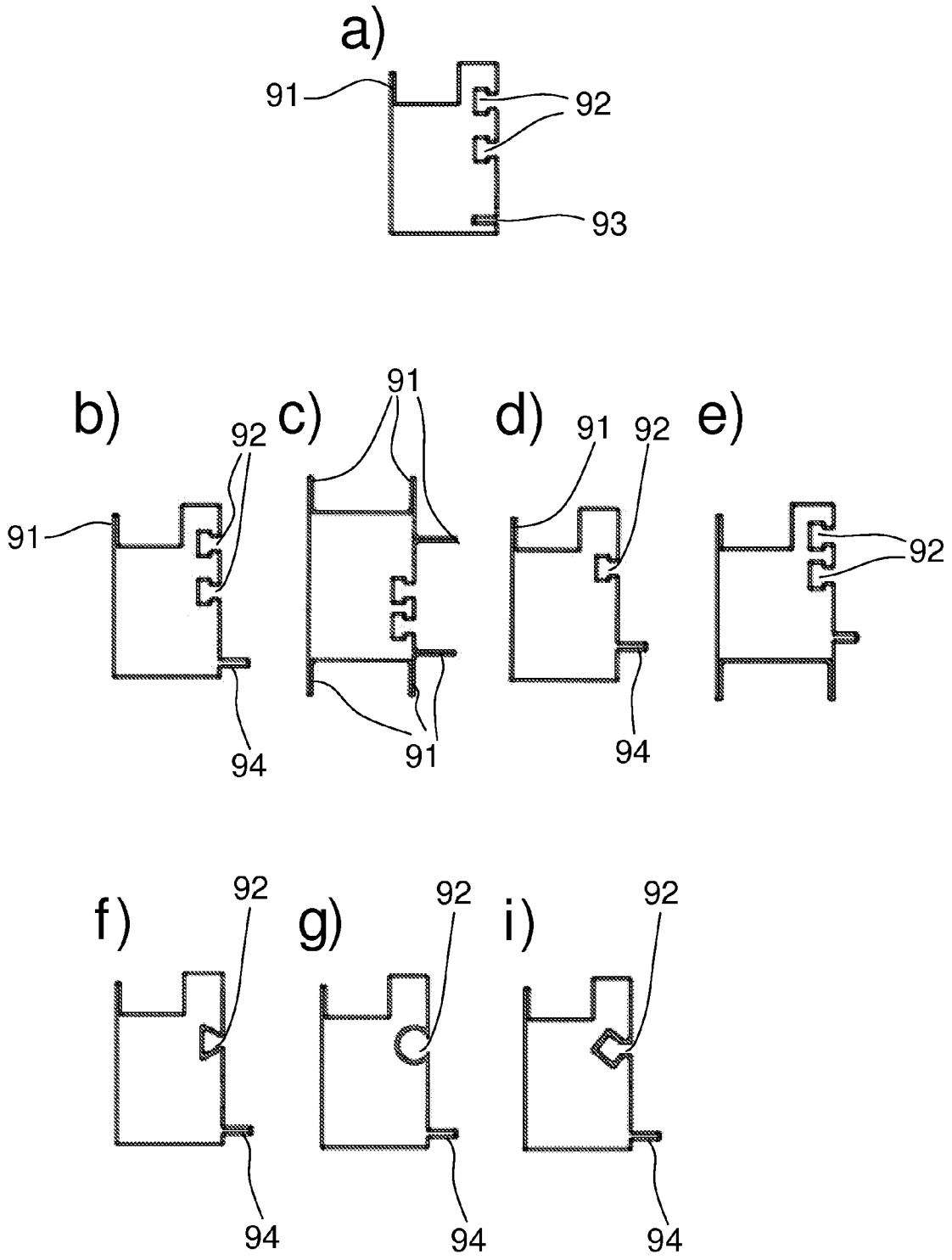
FIG. 11 different preferred configurations of a main floor profile in a cross-sectional view.
Figure 12:
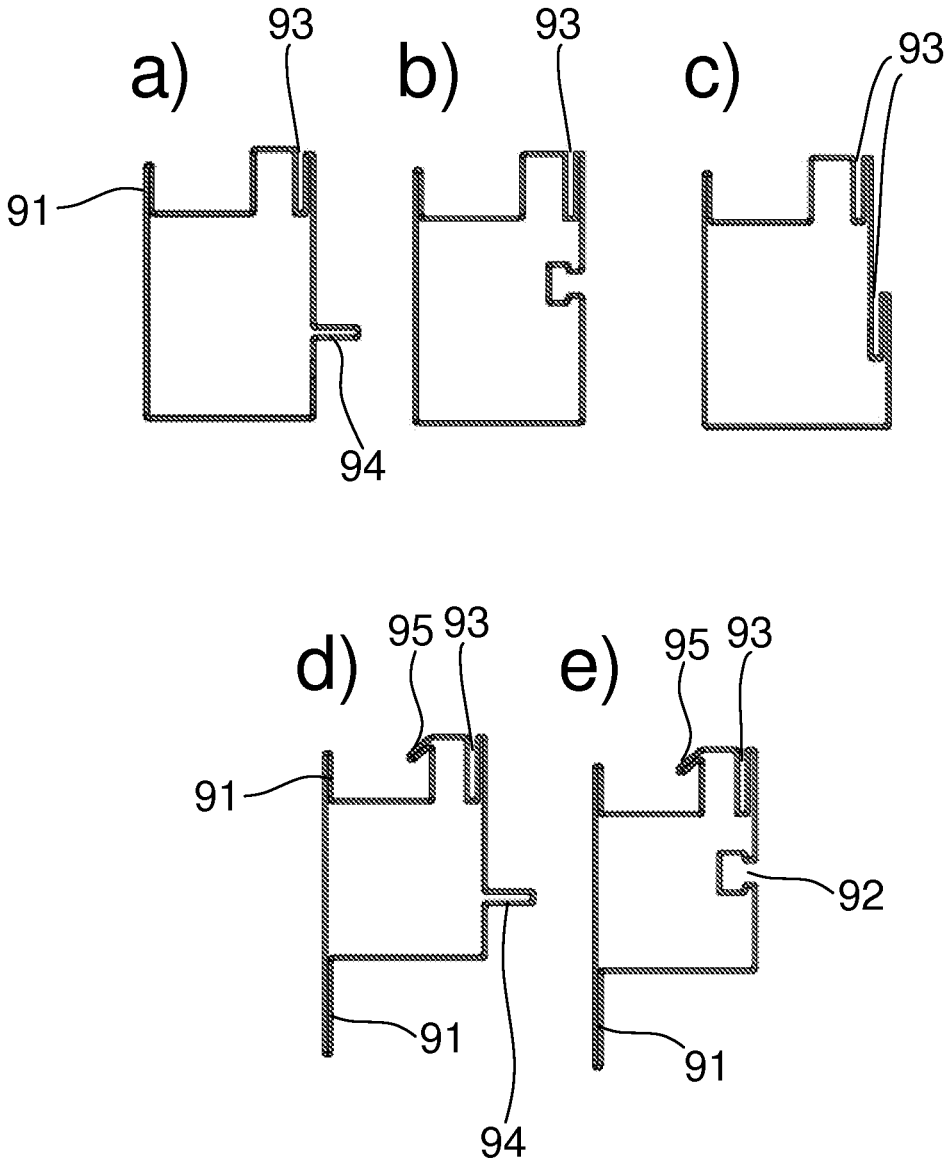
FIG. 12 different preferred configurations of floor or main roof profiles, which are suitable for slot-in connections, in a cross-sectional view.

FIGS. 7 and 8 illustrate an alternative connection possibility for fixing a secondary floor profile 41 on a main floor profile 1 or a secondary roof profile 42 on a main roof profile 2. For this, the corresponding main profile 1, 2 has one insert groove instead of two longitudinal grooves, in which slot nuts with threaded bores can be inserted. This involves, by way of example as shown in FIGS. 7 and 8, a longitudinal structure 78 in the form of a narrow longitudinal groove which, in the present case, is formed directly adjacent to a fold 78'. The secondary profile 41, 42 has, accordingly, one insert element 411. If the insert element 411 is inserted into the longitudinal groove, it engages around the fold 78'. The insert element 411 can itself be a fold of metal sheet, or, as shown in FIGS. 7 and 8, a simple, thus not double-folded, sheet metal section.

The secondary profile 41, 42 is folded here from a metal sheet and has an open cross section compared to a hollow profile. It is a C-shaped profile. The main profile 1, 2 furthermore has a longitudinal structure 79 in the form of a protrusion on which a lower bearing surface 412 of the secondary profile 41, 42 rests and is supported.

By means of the roll forming method, a number of different hollow profiles with, in part, very complicated structures can be produced from steel sheet. The cross sections of some of such hollow profiles, which can be used as support profiles 3, main floor profiles 1, 11, 12 or main roof profiles 2, 21, 22, are illustrated in FIGS. 9 to 12. They each have one, two, three, four, five or more longitudinal structures, each of which could have a form as described below.

A fold 91 can serve to form a boundary of a longitudinal channel, or a stop or bearing surface for positioning a further hollow profile or further structural elements, such as by way of example wall, floor or roof elements. Furthermore, a fold 91 can be easily and safely drilled through in order to fix such a structural element or a further hollow profile by means of screws.

The same functions as the fold 91 can be met by a projection 94. This can hereby be an elevation with uniform width, measured perpendicular to the longitudinal direction of the profile, wherein, however, this width is greater than double the thickness of the metal plate. In other words, the two sections of the metal plate bent onto one another do not lie directly on one another, as in the case of the fold, but exhibit a space between them, which can remain empty or be filled with a material, by way of example, with an insulation material. In all embodiments, a projection 94 can be used in place of a fold 91, or vice versa.

Furthermore, an inwardly widening groove 92 can be provided, thus a groove which has at the origin along the periphery of the hollow profile cross section a smaller width than at a certain distance closer to the inner region of the hollow profile. The widening groove 92 can hereby have a dovetailed cross section according to FIG. 11*f*), a round or circular cross section according to FIG. 11*g*), a diamond- or tilted-block-shaped cross section according to FIG. 11*i*), a T-shaped cross section according to one of FIG. 11*b*), 11*c*), 11*d*) or 11*e*), or a differently shaped cross section.

An insert groove 93 is kept sufficiently narrow in order to receive a close-fitting plate element, a sheet metal plate section or a fold section, as far as possible without any play, perpendicular to the groove width. An element of this kind or a section of this kind is preferably held in the insert groove 93 by means of clamping.

A bent fold 95 is a fold in which the two metal plate sections lying one on the other are again bent or curved together. Alternatively, the bent fold 95 can also be angled only in the region folded together. Expressed differently, a bent fold 95 can be a fold which does not protrude perpendicular from the surface of the hollow profile.

FIGS. 9*a*), 9*b*), 9*c*) and 9*d*) each show cross sections of different advantageous support profiles. Different preferred configurations of a main roof profile are on the other hand shown in cross-sectional view in FIGS. 10*a*), 10*b*), 10*c*) and 10*d*). FIGS. 11*a*), 11*b*), 11*c*), 11*d*), 11*e*), 11*f*), 11*g*) and 11*i*) in turn show cross-sectional views of preferred embodiments for a main floor profile. Finally, FIGS. 12*a*), 12*b*) and 12*c*) show different embodiments of a main floor profile and FIGS. 12*d*) and 12*e*) show different embodiments of a main roof profile, wherein the main floor profiles and the main roof profiles according to FIGS. 12*a*) to 12*e*) are characterized in that they each have at least one vertical insert groove 93 in which corresponding sections of a secondary profile can be inserted and can thus be fixed purely by a slot-in connection without screws or welding. The profile in FIG. 12*c*) has, additionally, one further vertical insert groove 93.

Figure 13:
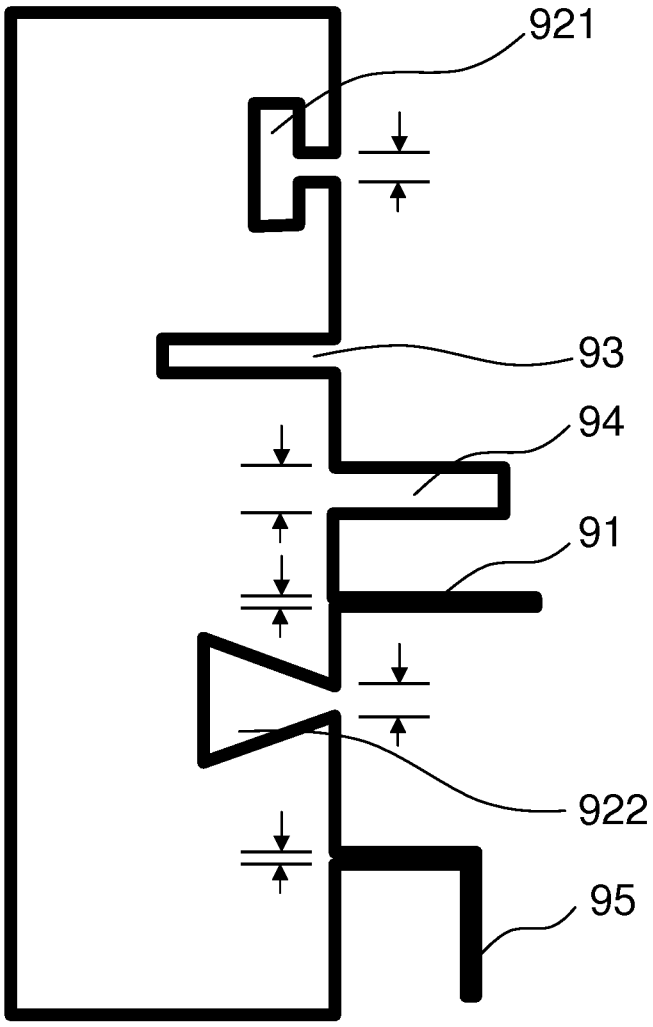
FIG. 13 a cross section of an imaginary hollow profile for illustrating and explaining different longitudinal structure designs.

FIG. 13 uses the cross section of an imaginary hollow profile to define the origin of a longitudinal structure and its width. The illustrated hollow profile has, in total, six different longitudinal structures, wherein their relevant widths at origin are indicated by means of arrowheads. They are hereby, from top to bottom, a T-shaped longitudinal groove 92, a longitudinal groove or insert groove 93 of uniform width, a projection 94, a fold 91, a dovetail-shaped longitudinal groove 922 and a bent or curved fold 95. It is this attachment width, measured along the periphery of the cross section of the hollow profile that must have a maximum value of 20, 15 or 10 millimeters. Structures of this kind cannot usually be achieved by means of press braking techniques. For this, instead, profile manufacturing methods have to be used, such as extrusion molding for aluminum or similar materials and roll forming processes in the case of sheet metal, more particularly in the case of steel sheet metal.

LIST OF REFERENCE NUMERALS

1 Main floor profile
11 Long main floor profile
12 Short main floor profile
2 Main roof profile
21 Long main roof profile
22 Short main roof profile
3 Support profile
31 Stacking plate
32 Reinforcing sleeve
41 Secondary floor profile
411 Insert element
412 Bearing surface
42 Secondary roof profile
51 Lift and holding bores
52 Corner fixing element
53 Angle fixing element
61 Floor cladding
62 Wall element
63 Floor element
64 Insulation element
65 Roof inner cladding
66 Roof element, roof outer cladding
71, 72, 73, . . . Longitudinal structures
81, 82, . . . Longitudinal channels
91, 92, 93, 94, 95, 921, 922 Special longitudinal structure cross sections

The invention claimed is:

1. A metallic frame structure of a modular and mobile housing unit, adapted for use as a residential container, an office container or a room module, comprising:

a plurality of horizontal main floor profiles connected detachably to one another to form a floor frame;

a plurality of horizontal main roof profiles connected detachably to one another to form a roof frame;

a plurality of vertical support profiles, each connected detachably to the horizontal main floor profiles by a floor corner connection and to the main roof profiles by a roof corner connection so that the floor frame and the roof frame are connected together in parallel and at a vertical distance from one another, wherein the support profiles are arranged so that when stacking two or more frame structures on top of each other, the frame structure stacked on top is supported mainly by the vertical support profiles, wherein at least one of the main floor profiles, main roof profiles or support profiles is a hollow metal profile which has a longitudinal structure extending along a longitudinal direction of the hollow metal profile and originating from an outer profile surface, which longitudinal structure is configured as a longitudinal elevation having a width of less than 20, 15 or 10 millimeters at its origin at the outer profile surface in a direction transverse to the longitudinal direction of the profile, wherein the hollow metal profile with the longitudinal structure is formed from folded steel sheet metal which is bent in one piece, two pieces or many pieces, wherein the longitudinal structure originating from the outer profile surface is formed by means of bending, whereby either the sheet metal is welded along the longitudinal direction of the profile or another method of connection is used to close the bent metal sheet along the longitudinal direction of the profile, so that a hollow metal profile is formed, and wherein the longitudinal structure configured as a longitudinal elevation is a fold in which two bent sheet metal plate sections lie one on the other so as to form the fold having the width at double the thickness of the sheet metal and so as to form the fold as a protrusion that protrudes perpendicularly from the longitudinal direction of the profile and either terminates to form a perpendicular protrusion or is bent again to form a bent protrusion, and wherein the longitudinal structure of the hollow profile forms a guide edge for positioning a section of one of the main floor profiles, main roof profiles or support profiles.

2. The frame structure as claimed in claim 1, wherein the floor corner connection or the roof corner connection is formed by means of longitudinal structure at least one corner connection comprises a vertical support profile of the vertical support profiles connected detachably to at least one pair of main floor profiles or pair of main roof profiles, each pair of main floor profiles or pair of main roof profiles comprising a pair of hollow metal profiles, and a pair of reinforcing elements, which are pushed into the hollow metal profiles of the pair of main floor profiles or the pair of main roof profiles at the at least one corner connection as guide elements both in order to facilitate assembly and to stabilize the at least one corner connection itself.

3. The frame structure as claimed in claim 2, characterized in that the at least one of the floor corner connection and the roof corner connection comprises the reinforcing elements intermediate the vertical support profile and the hollow profiles.

4. The frame structure as claimed in claim 1 wherein the hollow profile has two longitudinal structures configured as longitudinal elevations, and forming therebetween a longitudinal channel, having a C- or U-shaped cross section.

5. The frame structure as claimed in claim 1 wherein the longitudinal structure is configured as a longitudinal groove in which a slot nut with an internal thread is inserted for forming a screw connection, whereby at least one of the main floor profiles, main roof profiles or support profiles is connected detachably to another one of the main floor profiles, main roof profiles or support profiles.

6. The frame structure as claimed in claim 1 wherein the hollow profile has two, three, four or five longitudinal structures which are each formed as a longitudinal elevation or longitudinal groove.

7. The frame structure as claimed in claim 1 wherein the main floor profiles each have one or two longitudinal grooves and one or two longitudinal elevations, the main roof profiles each have one or two longitudinal grooves and one or two longitudinal elevations, and the support profiles each have two, three or four longitudinal elevations.

8. The frame structure as claimed in claim 1 further comprising a plurality of secondary floor profiles which are each arranged between two parallel main floor profiles and are connected detachably to the two parallel main floor profiles, or secondary roof profiles, which are each arranged between two parallel main roof profiles and are connected detachably to the two parallel main roof profiles, wherein the secondary floor profiles are supported or mounted to the longitudinal structures of the main floor profiles, or the secondary roof profiles are supported or mounted to the longitudinal structures of the main roof profiles.

9. The frame structure as claimed in claim 8 wherein the longitudinal structure of the hollow profile is configured as a longitudinal groove in which slot nuts with an internal thread are arranged, a screw connection being formed by which the secondary profiles are connected detachably to the main floor profiles or main roof profiles.

10. The frame structure as claimed in claim 8 wherein the longitudinal structure of the hollow profile is configured as a longitudinal groove in which holding sections of the secondary profiles engage in order to form slot-in connections between the hollow profile and the secondary profiles.

11. The frame structure as claimed in claim 8 wherein the secondary floor profiles or the secondary roof profiles are each formed as a hollow profile from a metal sheet which is bent from one piece, two pieces, or several pieces and is welded along the longitudinal direction of the profile.

12. An assembly kit for a modular and mobile housing unit, adapted for use as a residential container, an office container or a room module, with a metallic frame structure as claimed in claim 1.

13. A modular and mobile housing unit for a residential container, office container or room module, with a metallic frame structure as claimed in claim 1, and further comprising wall elements, roof elements and floor elements which are arranged on the frame structure and together with the frame structure enclose an interior region of the housing unit.

14. The housing unit as claimed in claim 13, wherein one or more of the wall elements, roof elements and floor elements are each arranged on longitudinal elevations or in longitudinal grooves of the main floor profiles, main roof profiles and support profiles, respectively.

15. A hollow profile, which is configured as a main floor profile, a main roof profile or a support profile for a metallic frame structure as claimed in claim 1, having a longitudinal structure extending along the longitudinal direction of the profile and originating from an outer profile surface, which longitudinal structure is configured as a longitudinal elevation or longitudinal groove having a width at its origin at the outer profile surface of less than 20, 15 or 10 millimeters in a direction transverse to the longitudinal direction of the profile.

16. A metallic frame structure of a modular and mobile housing unit, adapted for use as a residential container, an office container or a room module, comprising:

a plurality of horizontal main floor profiles connected detachably to one another to form a floor frame;

a plurality of horizontal main roof profiles connected detachably to one another to form a roof frame;

a plurality of vertical support profiles, each connected detachably to the horizontal main floor profiles by a floor corner connection and to the main roof profiles by a roof corner connection so that the floor frame and the roof frame are connected together in parallel and at a vertical distance from one another, wherein the support profiles are arranged so that when stacking two or more frame structures on top of each other, the frame structure stacked on top is supported mainly by the vertical support profiles, wherein at least one of the main floor profiles, main roof profiles or support profiles is a hollow metal profile which has a longitudinal structure extending along a longitudinal direction of the hollow metal profile and originating from an outer profile surface, which longitudinal structure is configured as a longitudinal elevation having a width of less than 20, 15 or 10 millimeters at its origin at the outer profile surface in a direction transverse to the longitudinal direction of the profile, wherein the hollow metal profile with the longitudinal structure is formed from steel sheet metal which is bent in one piece, two pieces or many pieces, wherein the longitudinal structure originating from the outer profile surface is formed by means of bending, whereby either the sheet metal is welded along the longitudinal direction of the profile or another method of connection is used to close the bent metal sheet along the longitudinal direction of the profile, so that a hollow metal profile is formed, wherein at least one corner connection comprises a vertical support profile of the vertical support profiles connected detachably to at least one pair of main floor profiles or pair of main roof profiles, each pair of main floor profiles or pair of main roof profiles comprising a pair of hollow metal profiles, and a pair of reinforcing elements, which are pushed into the hollow metal profiles of the pair of main floor profiles or the pair of main roof profiles at the at least one corner connection as guide elements both in order to facilitate assembly and to stabilize the at least one corner connection itself, wherein the at least one of the floor corner connection and the roof corner connection comprises the reinforcing elements intermediate the vertical support profile and the hollow profiles, wherein the longitudinal structure of the hollow metal profile is formed from folded sheet metal, and wherein the longitudinal structure configured as a longitudinal elevation is a fold in which two bent sheet metal plate sections lie one on the other so as to form the fold having the width at double the thickness of the sheet metal and so as to form the fold as a protrusion that protrudes perpendicularly from the longitudinal direction of the profile and either terminates to form a perpendicular protrusion or is bent again to form a bent protrusion, and wherein the longitudinal structure of the hollow profile forms a guide edge for positioning a section of one of the main floor profiles, main roof profiles or support profiles.

* * * * *